US007341000B2

(12) United States Patent
Williams

(10) Patent No.: US 7,341,000 B2
(45) Date of Patent: Mar. 11, 2008

(54) SLIPSHEET COMPACTOR SYSTEM

(75) Inventor: Kelly F. Williams, Delta (CA)

(73) Assignee: Kodak Graphic Communications Canada Company, Burnaby (CA)

( * ) Notice: Subject to any disclaimer, the term of this patent is extended or adjusted under 35 U.S.C. 154(b) by 385 days.

(21) Appl. No.: 10/612,918

(22) Filed: Jul. 7, 2003

(65) Prior Publication Data

US 2004/0055478 A1 Mar. 25, 2004

Related U.S. Application Data

(60) Provisional application No. 60/393,657, filed on Jul. 5, 2002.

(51) Int. Cl.
*B30B 7/04* (2006.01)
*B65H 5/10* (2006.01)

(52) U.S. Cl. ..... 100/233; 100/172; 100/176; 100/189; 100/214; 241/236; 271/267; 271/272; 271/314

(58) Field of Classification Search ..... 100/94–97, 100/98 R, 178, 179, 214, 215, 218, 233, 100/240, 245, 155 R, 176, 210, 188 R, 189; 241/235, 236; 271/84, 69, 267, 272, 314
See application file for complete search history.

(56) References Cited

U.S. PATENT DOCUMENTS

| | | | | |
|---|---|---|---|---|
| 1,819,480 | A * | 8/1931 | Paxton | 71/23 |
| 2,686,466 | A * | 8/1954 | Lee | 100/97 |
| 3,109,367 | A * | 11/1963 | Albrecht et al. | 430/49.3 |
| 3,713,358 | A * | 1/1973 | Honeycutt et al. | 83/35 |
| 5,186,397 | A * | 2/1993 | Orlando | 241/23 |
| 5,910,079 | A * | 6/1999 | Watanabe | 493/352 |
| 6,026,741 | A * | 2/2000 | Lippens et al. | 100/41 |
| 6,715,410 | B2 * | 4/2004 | Boucher et al. | 100/191 |

* cited by examiner

*Primary Examiner*—Jimmy T. Nguyen

(57) ABSTRACT

A slip-sheet compactor for an imaging device with automatic media handling capabilities provides a two-stage compaction for a slipsheet removed from a media sheet to be imaged. A pair of rollers advances the slipsheet into a pre-compression chamber effecting a first compression or folding operation. In a second compression, a plunger sweeps the pre-compression chamber, which is narrowed towards an exit aperture thus effecting a second compression on the slipsheet material.

23 Claims, 6 Drawing Sheets

SLIPSHEET COMPACTOR SYSTEM

REFERENCE TO RELATED APPLICATION

This application claims the benefit of U.S. Application No. 60/393,657 filed on Jul. 5, 2002 and entitled Slipsheet Compactor System which is hereby incorporated herein by reference.

TECHNICAL FIELD

The invention relates to imaging systems and more particularly to the handling of disposable slipsheets interspersed between media sheets in stacks of media sheets.

BACKGROUND

Imaging systems capable of exposing images on media are well known in the art. Commonly, although not exclusively, media are supplied from vendors in stacks of sheets. Slipsheets are interspersed between the media sheets to prevent the sensitive surfaces of the media sheets from adhering to one another or being otherwise damaged. For imaging devices with automated media handling systems it is convenient to load stacks of such media sheets into the imaging device with the slip-sheets in place. The presence of the slipsheets may in some cases aid in the handling of the media allowing adjacent media sheets to slide more easily over each other in loading operations.

The reliable disposal of slipsheets presents a problem for media handling systems. Devices designed to have a large stack of media sheets on-line at any one time must provide some mechanism for accumulating slipsheets for eventual disposal. Slipsheets occupy a significant volume and may cause blockages in the operating of media handlers as more and more slip-sheets are accumulated. Such blockages, while typically easily cleared, represent a reduction in reliability, which in a competitive industry represents a reduction in value to the customer.

There remains a need for better methods and apparatus for handling slipsheets removed from media in loading operations.

SUMMARY OF THE INVENTION

The invention is described in relation to a system for compacting a slipsheet and ejecting the compacted slipsheet in an easily disposable form.

In one aspect of the invention a slipsheet compactor has an elongate pre-compression chamber with an entrance and an exit aperture. A pair of opposing input rollers are located at the entrance to the pre-compression chamber, at least one of the rollers provided with rotational drive for advancing the slipsheet into the pre-compression chamber. A moveable plunger sweeps the volume of the pre-compression chamber between the entrance and the exit aperture.

In another aspect of the invention a method for compacting a slipsheet is provided. A slipsheet is removed from an imaging media and pre-compressed. The slipsheet is then further compressed whereafter it is ejected.

BRIEF DESCRIPTION OF DRAWINGS

In drawings which illustrate by way of example only preferred embodiments of the invention.

DESCRIPTION

Figure 1A:
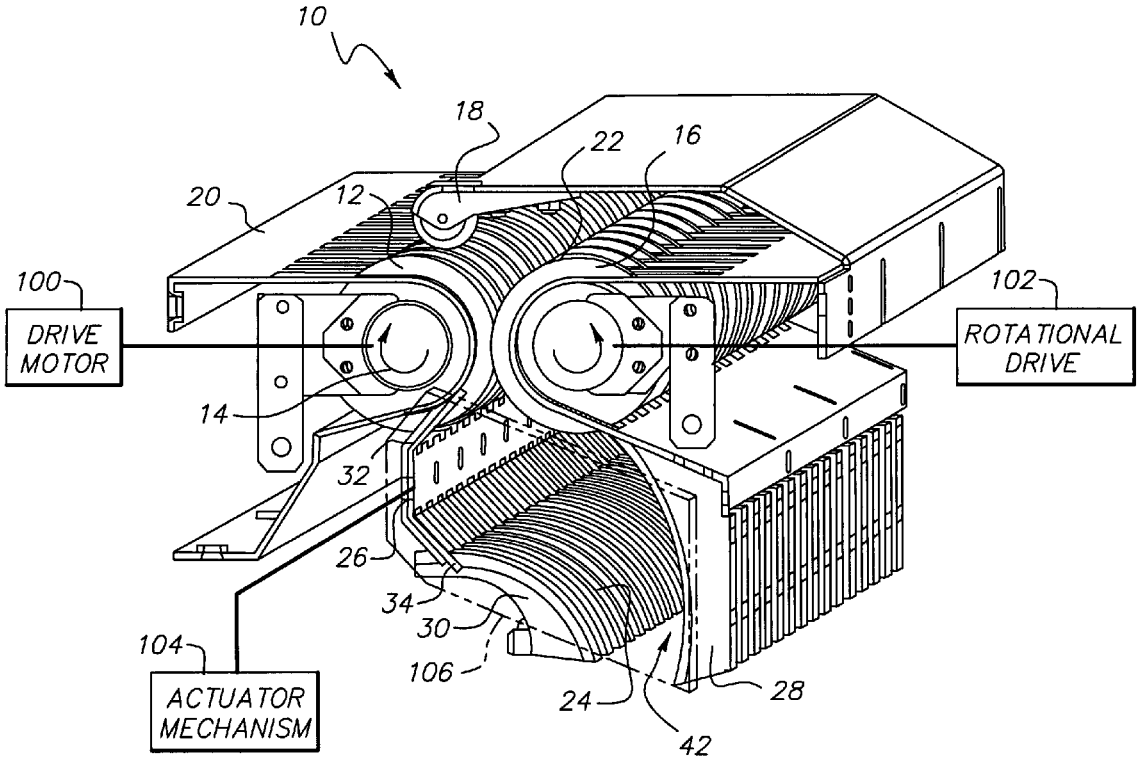
FIGS. 1-A to 1-D depict in perspective view a series of steps in the operation of a slipsheet compactor according to one embodiment of the invention.
Figure 1B:
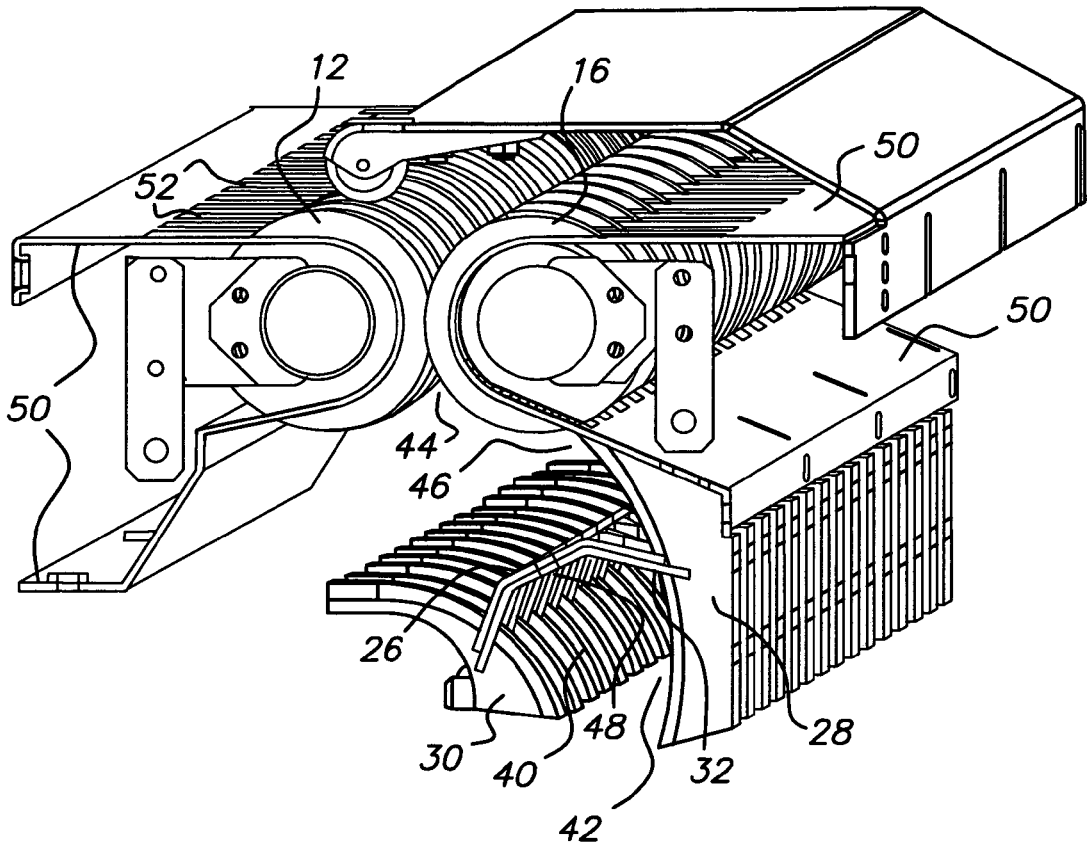
Figure 1C:
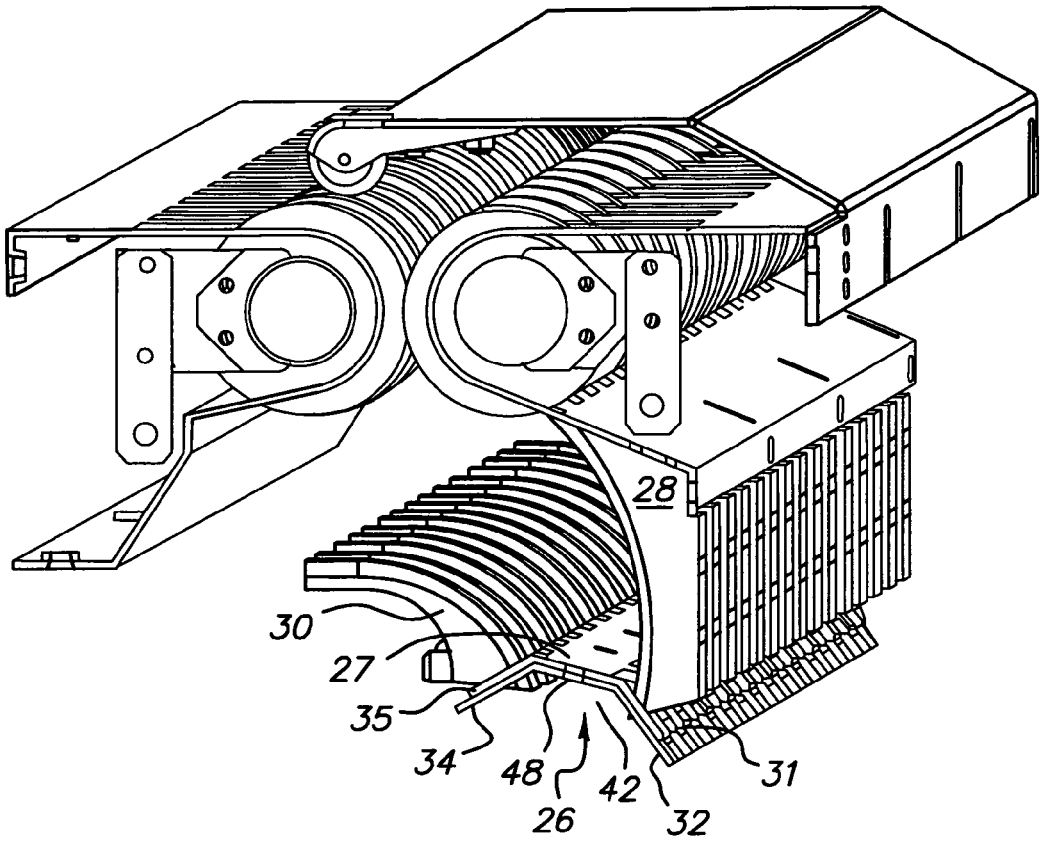
Figure 1D:
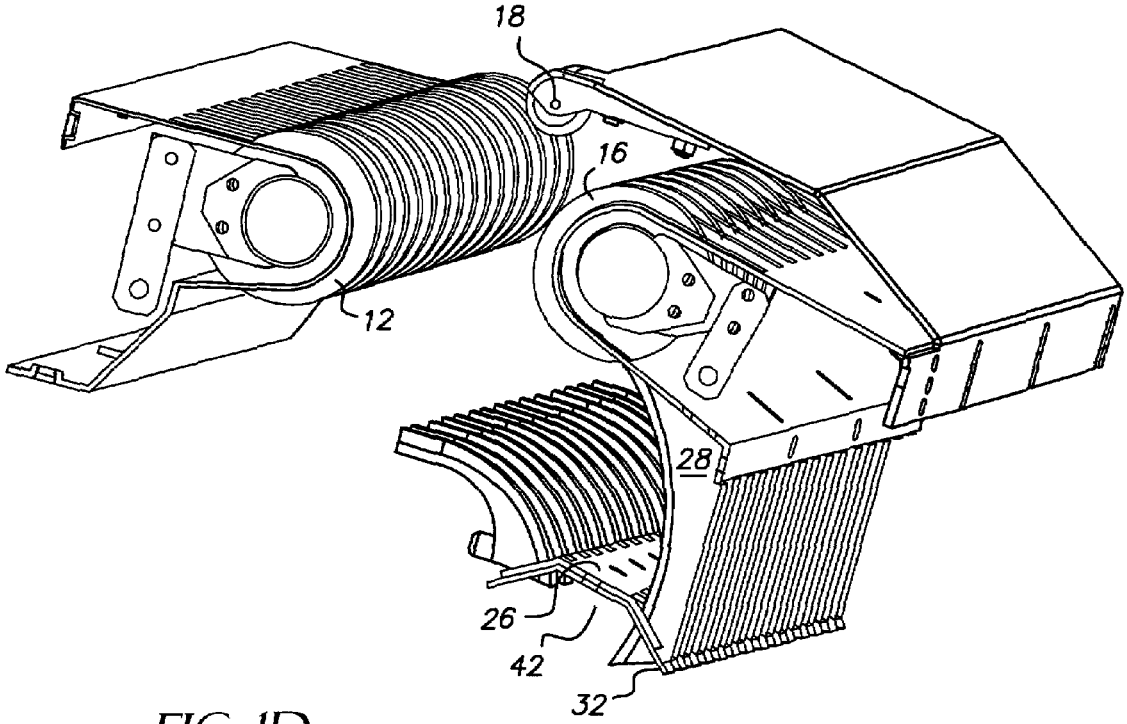

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The invention provides an apparatus that performs a double compaction on each slipsheet. A slipsheet, previously removed from a media sheet, is fed into a pre-compression chamber by a pair of rollers. The pre-compression chamber is sized to force the slipsheet to wrap on itself in loosely folded or crumpled form. A second compaction is provided by a plunger that sweeps the volume of the pre-compression chamber thus moving the slipsheet toward an exit aperture. The pre-compression chamber narrows toward the exit aperture. The slipsheet is further compacted as the plunger moves it toward the exit aperture. This compacts the slipsheet into a reduced volume and allows the slipsheet to be collected for disposal. Advantageously, due to the additional compacting provided by the double stage compression of this invention, a greater number of media sheets may be run through the imaging system before requiring operator intervention to empty the slipsheet disposal receptacle or clear a blockage.

Specific aspects of the invention will now be discussed with reference to FIGS. 1-A - 1-D. FIG. 1-A shows a compactor 10. Compactor 10 has an input roller 12 that is rotated in the direction indicated by arrow 14 by a motor drive 100. A second input roller 16 engages roller 12. Roller 16 rotates in a direction opposite to roller 12 and can be driven by a rotational drive 102. Typically, input rollers 12 and 16 are faced with a resiliently compressible material such as rubber or foam, but this is not mandated and one or both of the rollers may even have metallic surfaces.

A slipsheet (not shown) travels along an input table 20. Input rollers 12 and 16 operate in combination with a wheel 18 to urge the slipsheet toward an input roller engagement area 22 at the nip between rollers 12 and 16. A slipsheet once engaged between rollers 12 and 16 is advanced between input rollers 12 and 16 into a chamber 24. Chamber 24 is defined on a first side by input rollers 12 and 16, on a second side by a plunger 26, on a third side by an upper guide 28, and on a fourth side by a lower guide 30. Longitudinal ends of pre-compression chamber 24 may be closed by end-plates 106.

The advancing action of input rollers 12 and 16 causes the slipsheet to crumple or fold into chamber 24, thus effecting some pre-compression. Chamber 24 has a size chosen to provide sufficient pre-compression for a typical sheet that will be handled by compactor 10.

After the slipsheet has been completely fed into chamber 24 plunger 26 advances to compact the slipsheet further. Plunger 26 is driven by an actuator 104 along an arc approximately defined by lower guide 30. Referring now to FIG. 1-B, plunger 26 is shown being extended to force a slipsheet (not shown) into a constricted throat area 40 near exit aperture 42, thus effecting further compaction of the slipsheet. Finally, as shown in FIG. 1-C, plunger 26 has been extended until it is at exit aperture 42 to expel the slipsheet. A receptacle such as a bin, box, bag or the like may be placed under exit aperture 42 to collect compacted slipsheets.

In an optional final step shown in FIG. 1-D upper guide 28 is moved out of the way of plunger 26 to ensure that any detached slipsheet material does not end up behind plunger 26 as the plunger is returned to the position shown in FIG. 1-A ready for the next compaction cycle. In the embodiment shown, upper guide 28 is moved pivotally together with input roller 16 and wheel 18 although this is not mandated.

For a common large format media (for example 58 inches×80 inches) with paper slipsheets, a convenient size for pre-compression chamber 24 is approximately 100 mm×60 mm in cross section and extending the width of the media (for example about 1500 mm for 80 inch wide media). Exit aperture 42 may be a slot approximately 25 mm wide, for example, extending the width of the media.

The slipsheet is free to run out exit aperture 42 at any time, as the exit aperture is always open to the receptacle below but the slipsheet usually does not exit on its own due to the small size of the opening. The compacted slipsheet on leaving exit aperture 42 usually re-expands to some extent, preventing it from re-entering pre-compression chamber 24.

The slipsheet forced into a receptacle bin is significantly compacted. The compaction force originates primarily from the face of plunger 26. A plunger is more effective in compacting than rollers alone. Furthermore, the two stage compacting has the advantage of significantly lowering the wear rate of input rollers 12 and 16. Since each slipsheet is individually compacted and expelled from the compacting device, there is little chance of pre-compression chamber 24 becoming plugged with multiple slip-sheets. In previously utilized single stage compaction devices having only a pair of rollers for compaction, roller wear was found to be a limiting factor. Such wear was further accelerated when the device became blocked.

Referring again to FIGS. 1-A to 1-D various construction details of compactor 10 will now be discussed in greater depth. In FIG. 1-A plunger 26 is shown as having a plurality of fingers 32 and 34 that intermesh with the other surfaces in the pre-compression chamber 24. Fingers 32 and 34 can be said to be contacting the surfaces that they intermesh with even if there is some clearance between the fingers and the surfaces. The intermeshing ensures that a slipsheet entering pre-compression chamber 24 will not be caught on any protruding surfaces or be caught in the gap between elements.

Fingers 32 on plunger 26 are disposed to intermesh with grooves formed in roller 12. Likewise, fingers 34 on plunger 26 are disposed to intermesh with lower guide 30. As plunger 26 moves forward toward the position shown in FIG. 1-B fingers 32, initially intermeshed with input roller 12, successively intermesh with input roller 16 and then with upper guide 28. In the illustrated embodiment there are areas 44 and 46 in the path of plunger 26 where fingers 32 are not intermeshed with any of the rollers or guides but these may be kept to a minimum by design.

Preferably fingers 32 are oriented approximately tangential to the exposed arc of roller 12. Area 44 is cleared of slip-sheet material by the surface friction of input rollers 12 and 16, each roller independently acting on the slipsheet. At a position in between that shown in FIG. 1-A and FIG. 1-B (actual position not shown), where plunger fingers 32 are in engagement with roller 16, the interaction between the roller 16 and the tips of the fingers 32 helps to clean any slipsheet material from the tips of fingers 32. The roller velocity is relatively higher and almost perpendicular to the velocity of the upper tips of plunger fingers 32 at this point, thus moving any slipsheet material away from fingers 32.

Preferably, input rollers 12 and 16 are protected from slipsheet material wrapping around them by providing grooves in the rollers. Contact surfaces of the rollers project through a plurality of slots 52 in the protective housings 50 that partially encircle each roller. Slotted housings 50 reduce the possibility that slipsheet material could wrap around a roller causing a blockage. Slots 52 are sized to clear the grooves in rollers 12 and 16 without interference.

Advantageously fingers 32 and 34 of plunger 26 are angled forward of the plunger centre portion 48 in a flattened "c" shape. The angled fingers function to urge the pre-compressed slipsheet towards the center 48 of the face of plunger 26 resulting in more effective compaction, more effective clearing of pre-compression chamber 24, and less probability of ripping the slipsheet.

Fingers 34 are disposed to engage lower guide 30 throughout the traversal of plunger 26 except for right at the end of the compression stroke. As shown in FIG. 1-C, at the end of the stroke fingers 32 and 34 may protrude out from upper and lower guides 28 and 30 in a manner that minimizes damage to the already compressed slipsheet and reduces the likelihood of a blockage. The ends of fingers 32 and 34 are relatively far away from the newly compressed slipsheets at this point due to the constriction of exit aperture 42.

Advantageously the interaction of plunger 24 with upper and lower guides 28 and 30 forms a tapered pre-compression chamber volume that increases the compression on the slipsheet as it is forced toward exit aperture 42. The upper and lower guides 28 and 30 have an abrupt edge at the exit aperture 42. The slipsheet is increasingly compressed during the stroke of plunger 26 and on being ejected through exit aperture 42 expands slightly. This expansion results in slipsheets being unable to re-enter the pre-compression chamber under normal operating circumstances, even if the storage receptacle becomes overfilled.

Preferably, plunger face 48 is constructed from a plastic or other suitable flexible material with the addition of a rigid backbone 27 for support (FIG. 1-C). This provides a plunger face 48 which is flexible but sufficiently strong to compress the slipsheets. Backbone 27 may have finger portions 31 and 35 which extend at least part way along fingers 32 and 34 to support fingers 32 and 34. The flexibility allows the plunger to purge the compressed slipsheet when the plunger is retracted. This is done by allowing upper and lower fingers 32 and 34 to pull away from finger supports 31 and 35. It is desirable to compact slipsheets without tearing pieces off the slipsheets since detached slipsheet material may hinder a subsequent compression process or become lodged in the mechanism and induce premature wear. It has been found in trials that a compactor having a substantially rigid plunger was less reliable than a compactor having a flexible plunger, primarily due to slipsheet material tearing off or becoming detached and remaining inside pre-compression chamber 24 prior to commencing the next compaction cycle.

Advantageously, as shown in FIG. 1-D, input roller 16 and upper guide 28 are constructed so that they can be pivoted away from input roller 12 prior to retracting plunger 26. This moves upper guide 28 and roller 16 out of intermeshed engagement with fingers 32 so that fragments of slip-sheet that may have been detached may escape being pushed back by the retracting plunger 26. This operation, while not essential to the invention, has been found to improve the overall operating reliability of compactor 10.

In the embodiment shown in FIGS. 1-A to 1-D, input roller 16 has a larger exposed arc length in pre-compression chamber 24 than roller 12. Pieces of slipsheet may be sheared between roller 16 and slotted cover 50. The resulting debris may be deposited in the compactor mechanism. Over time, this build-up of debris can accelerate the wear on rollers 12 and 16 as well as other components. This problem can be reduced by using dissimilar materials for the surfaces of rollers 12 and 14. Although the exposed arc length in roller 16 is larger than roller 12, roller 16 can be made of a lower friction material to make the frictional side loads on rollers 12 and 16 near equal or similar in magnitude.

Figure 2:
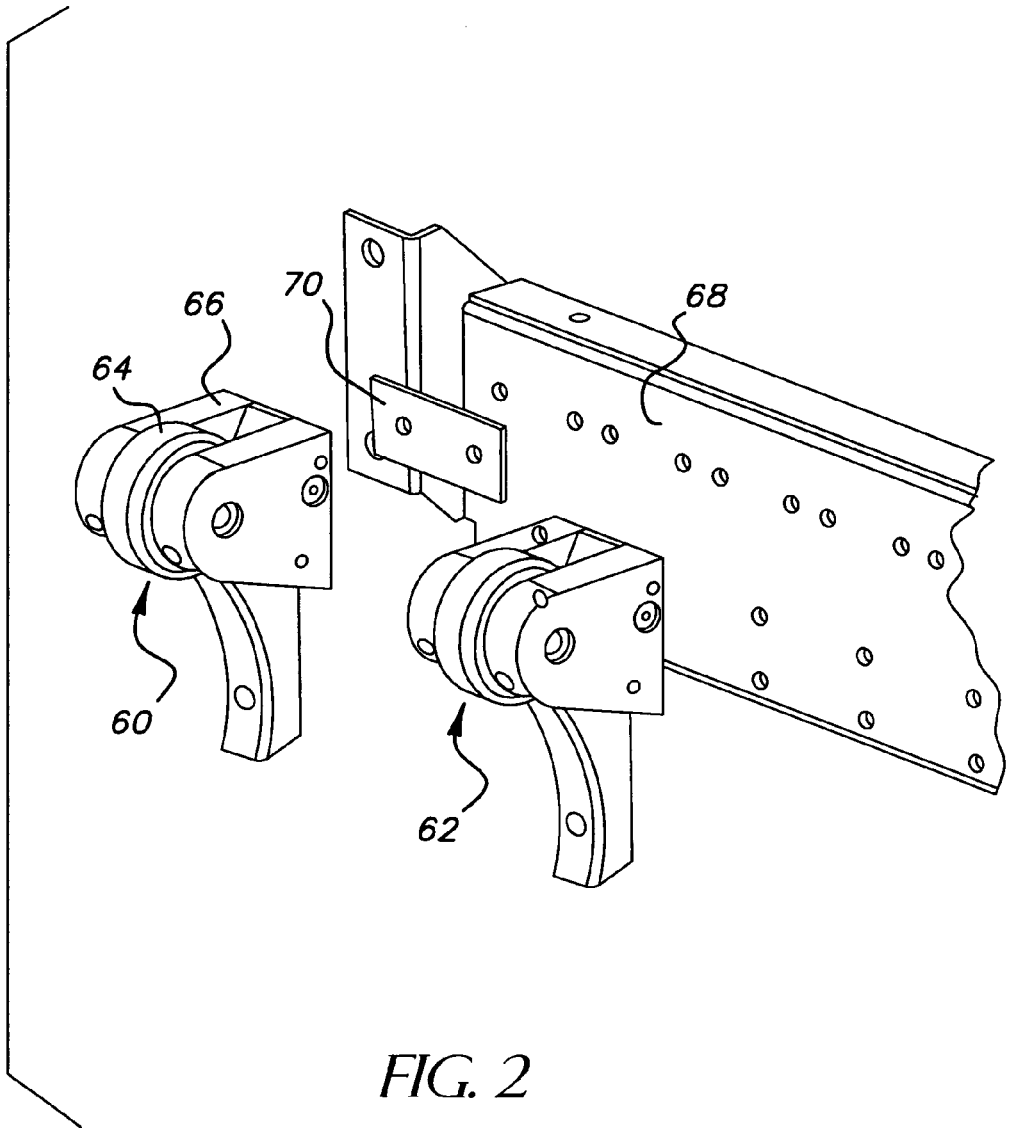
FIG. 2 depicts a part of a roller assembly for a compactor according to an alternative embodiment of the invention.

In another embodiment roller 16 comprises a plurality of independent roller units as shown in FIG. 2. A plurality of independent modular roller assemblies 60 and 62, each comprising a housing 64 and a roller wheel 66, are attached to a backplane 68. Using modular units 60 and 62 simplifies servicing and allows replacement of worn or damaged units rather than the entire roller. The use of modular units 62 and 66 also simplifies assembly and reduces assembly time.

Another benefit to the construction of FIG. 2 is that individual units may be shimmed away from backplane 68. In FIG. 2, a shim 70 spaces roller unit 60 further away from backplane 68 than roller unit 62. By allowing the engagement with the driving roller 12 shown in FIG. 1-A to be adjusted for each roller unit tolerances may be improved. Roller units 60 and 62 also incorporate the slotted housing 50 shown in FIG. 1-B thus reducing part count in this respect. There is also increased safety to an operator because if a person's finger or limb is accidentally drawn into the roller assembly 12 and 16, the independent rollers will provide less traction on a limb.

Another advantage of being able to individually shim each roller unit is to make possible the introduction of an offset to compensate for crowning commonly experienced with single piece rollers. The offset allows adjustment of the engagement pressure for each roller to be substantially the same. This adjustment is not available for a single piece roller.

Figure 3:
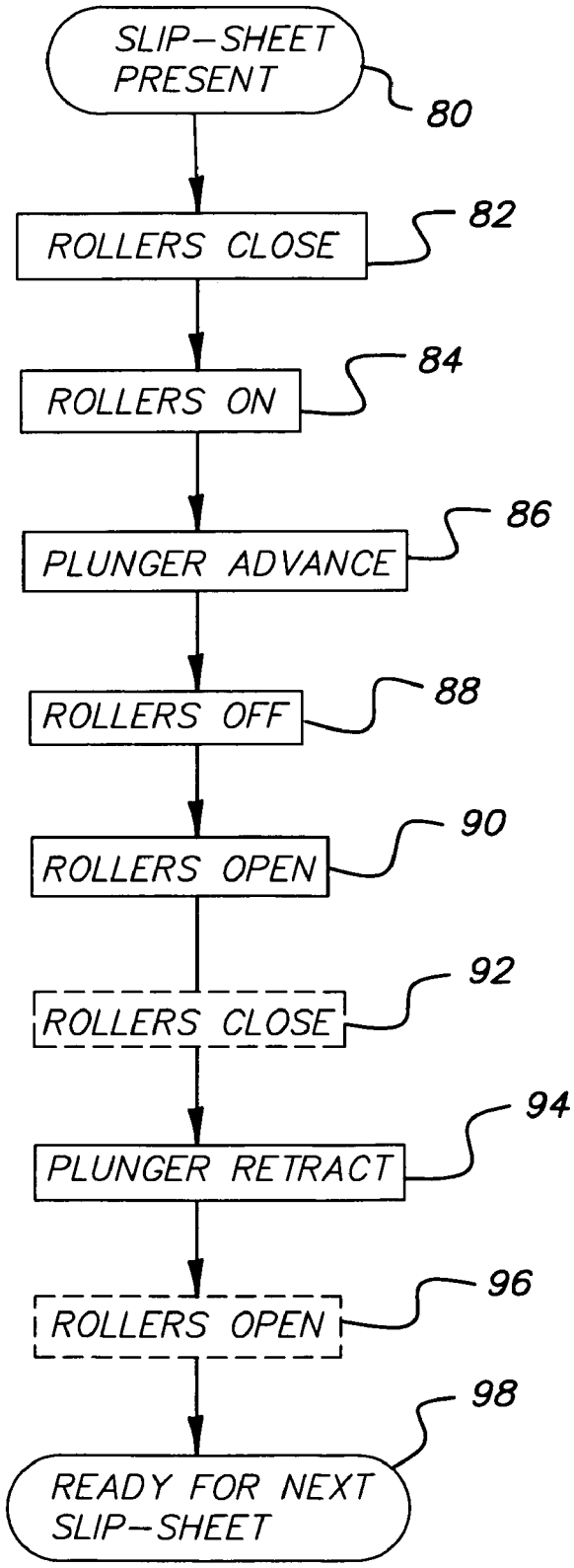
FIG. 3 is a flowchart depicting a process and sequence of operations for a slipsheet compactor.

FIG. 3 is a process flowchart showing an example sequence of operations in the compaction of a slipsheet. A slipsheet is present at the entry to the compactor device and the rollers are closed in step 80. In step 82, the input rollers begin turning. Once the slipsheet is fed into pre-compression chamber 24, the plunger is advanced in step 86 to further compact the slipsheet. At this stage, the roller drive may be deactivated in step 88. At the extent of the plunger advance in the pre-compression chamber, the slipsheet is expelled from the pre-compression chamber and the rollers and upper guide may be rotated to open in step 90 allowing any detached material to clear the plunger. In optional step 92, the rollers may again be closed to allow the plunger to retract safely in step 94. In another optional step 96, the rollers reopen ready for the next slipsheet cycle. Steps 92 and 96 provide an optional safety feature by closing the compactor so that a person servicing the device is prevented from catching a hand or limb in the compactor while the plunger is retracted. While under normal use the compactor may be completely enclosed, preventing access to the pre-compaction chamber and rollers, during servicing when the compactor may be opened for inspection the high compaction forces represent a hazard to the service personnel which may be reduced by the steps 92 and 96 as detailed above.

As would be appreciated by a person skilled in the art, some of the benefits and advantages of the invention may be experienced even if the operation sequence is changed. As an example, more than one slipsheet could be fed into the pre-compression chamber prior to initiating the second stage plunger compression. Such changes are considered to fall within the scope of this invention and the particular sequence shown in FIG. 3 is included only as a possible example of operation.

Where a component (e.g., an assembly, device, member etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A slipsheet compactor comprising:

an elongate pre-compression chamber having an entrance and an exit aperture;

a pair of opposing input rollers located at the entrance to the pre-compression chamber, the pair of opposing input rollers configured to advance the slipsheet into the pre-compression chamber, at least one of the rollers provided with rotational drive to advance a slipsheet into the pre-compression chamber; and a moveable plunger operable to sweep a volume of the pre-compression chamber between the entrance and the exit aperture, the moveable plunger including a plurality of fingers extending outwardly from two sides of the plunger and the movable plunger further including a flexible material.

2. A slipsheet compactor according to claim 1, wherein the pre-compression chamber has a transverse cross section that is inwardly tapered towards the exit aperture.

3. A slipsheet compactor according to claim 1, wherein the pre-compression chamber comprises a pair of spaced apart guides defining a passageway having an entrance at one end thereof and defining the exit aperture at the other end thereof, the passageway inwardly tapered at least in a portion in proximity to the exit aperture.

4. A slipsheet compactor comprising:

an elongate pre-compression chamber having an entrance and an exit aperture;

a pair of opposing input rollers located at the entrance to the pre-compression chamber, at least one of the rollers provided with rotational drive for advancing slipsheets into the pre-compression chamber;

a moveable plunger operable to sweep a volume of the pre-compression chamber between the entrance and the exit aperture, wherein the pre-compression chamber comprises a pair of spaced apart guides defining a passageway having an entrance at one end thereof and defining the exit aperture at the other end thereof, the passageway inwardly tapered at least in a portion in proximity to the exit aperture, and the plunger comprises a plurality of outwardly extending fingers and at least one of the guides has corresponding channels for intermeshing with the fingers.

5. A slipsheet compactor comprising:

an elongate pre-compression chamber having an entrance and an exit aperture;

a pair of opposing input rollers located at the entrance to the pre-compression chamber, at least one of the rollers provided with rotational drive for advancing slipsheets into the pre-compression chamber;

a moveable plunger operable to sweep a volume of the pre-compression chamber between the entrance and the exit aperture, wherein the pre-compression chamber comprises a pair of spaced apart guides defining a passageway having an entrance at one end thereof and defining the exit aperture at the other end thereof, the passageway inwardly tapered at least in a portion in proximity to the exit aperture, and the plunger comprises a plurality of outwardly extending fingers and at least one of the input rollers has corresponding channels in the surface thereof for intermeshing with the fingers.

6. A slipsheet compactor according to claim 5, wherein the fingers are arranged to remain generally tangential to the surface of the at least one input roller as the plunger is swept past the at least one input roller.

7. A slipsheet compactor comprising:

an elongate pre-compression chamber having an entrance and an exit aperture;

a pair of opposing input rollers located at the entrance to the pre-compression chamber, at least one of the rollers provided with rotational drive for advancing slipsheets into the pre-compression chamber;

a moveable plunger operable to sweep a volume of the pre-compression chamber between the entrance and the exit aperture, wherein the pre-compression chamber comprises a pair of spaced apart guides defining a passageway having an entrance at one end thereof and defining the exit aperture at the other end thereof, the passageway inwardly tapered at least in a portion in proximity to the exit aperture, and the plunger comprises a central backbone with plurality of fingers extending outwardly from either side of the backbone.

8. A slipsheet compactor according to claim 7, wherein the fingers are angled forwardly with respect to the backbone.

9. A slipsheet compactor according to claim 7, wherein the fingers on one side of the backbone are disposed to contact one of the pair of spaced apart guides and the fingers on the other side of the backbone are disposed to sequentially contact each of the input rollers and the other one of the pair of spaced apart guides during the sweeping of the pre-compression chamber.

10. A slipsheet compactor according to claim 4, wherein the plunger is flexible.

11. A slipsheet compactor according to claim 10, wherein the plunger comprises a rigid backbone supporting a flexible face.

12. A slip sheet compactor according to claim 11, wherein the rigid backbone comprises finger support portions extending at least part way along each of a plurality of the fingers.

13. A slipsheet compactor according to claim 1, comprising a mechanism configured to sweep the plunger through the pre-compression chamber along a curved path.

14. A slip sheet compactor according to claim 1, wherein at least one of the input rollers is faced with a compliant material.

15. A slipsheet compactor according to claim 1, wherein each of the opposing input rollers is provided with a rotational drive and the drive is adapted to drive each of the input rollers at rates such that a surface speed at the peripheral surface of each roller is substantially equivalent.

16. A slip sheet compactor according to claim 1, wherein at least one of the input rollers comprises a plurality of roller units longitudinally arrayed to provide a roller surface.

17. A slipsheet compactor according to claim 1, wherein the pre-compression chamber has a longitudinal width greater than a width of the slipsheet.

18. A slipsheet compactor according to claim 16, wherein the pre-compression chamber extends between a pair of end plates located at longitudinal ends thereof.

19. A slipsheet compactor according to claim 1, comprising a guide wheel located in proximity to the input rollers outside the pre-compression chamber.

20. A slipsheet compactor according to claim 1, wherein at least one of the input rollers is moveable to open the entrance to the pre-compression chamber.

21. A slipsheet compactor comprising:

an elongate pre-compression chamber having a volume, an entrances, and an exit aperture;

a pair of opposing input rollers located at the entrance to the pre-compression chamber, at least one of the rollers provided with rotational drive for advancing slipsheets into the pre-compression chamber; and a moveable plunger including a central backbone with a plurality of fingers extending outwardly from opposing sides of the central backbone, the plunger being operable to move from the entrance of the pre-compression chamber to the exit aperture of the pre-compression chamber to sweep the volume of the pre-compression chamber, wherein a first one of the input rollers has an arc length exposed in the pre-compression chamber longer than an exposed arc length of a second one of the input rollers.

22. A slipsheet compactor comprising:

an elongate pre-compression chamber having an entrance and an exit aperture;

a pair of opposing input rollers located at the entrance to the pre-compression chamber, at least one of the rollers provided with rotational drive for advancing slipsheets into the pre-compression chamber; and a moveable plunger operable to sweep a volume of the pre-compression chamber between the entrance and the exit aperture, a first one of the input rollers having an arc length exposed in the pre-compression chamber longer than an exposed arc length of a second one of the input rollers, wherein the first one of the input rollers has a coefficient of friction lower than a coefficient of friction of the second one of the input rollers.

23. A slipsheet compactor according to claim 1, the flexible material being located on a face of the plunger, wherein the plunger comprises a rigid backbone supporting the flexible material face.

* * * * *